United States Patent [19]

Nakajima

[11] Patent Number: 4,574,401

[45] Date of Patent: Mar. 11, 1986

[54] TOILET BOWL

[76] Inventor: Kenji Nakajima, 3-5, 6-chome, Nagayoshidedo, Hirano-ku, Osaka, Japan

[21] Appl. No.: 574,176

[22] Filed: Jan. 24, 1984

[30] Foreign Application Priority Data

Jan. 24, 1983 [JP] Japan ..... 58-9773[U]
Nov. 30, 1983 [JP] Japan ..... 58-186625[U]

[51] Int. Cl.[4] ..... A47K 13/10
[52] U.S. Cl. ..... 4/251; 4/661; 4/237
[58] Field of Search ..... 4/251, 661, 237

[56] References Cited

U.S. PATENT DOCUMENTS

| | | | |
|---|---|---|---|
| 1,999,555 | 4/1935 | Adams | 4/251 |
| 2,236,576 | 4/1941 | Loebner | 4/251 |
| 2,318,518 | 5/1943 | Opperer | 4/251 |
| 2,758,315 | 8/1956 | Hylton | 4/251 |
| 3,191,193 | 6/1965 | Bogenberger | 4/251 |
| 3,717,884 | 2/1973 | Mantooth | 4/251 X |
| 3,783,455 | 1/1974 | Vanderbrook | 4/251 X |
| 3,935,601 | 2/1976 | Hermann | 4/251 |
| 4,129,907 | 12/1978 | Vaughan et al. | 4/251 |

*Primary Examiner*—Henry K. Artis
*Attorney, Agent, or Firm*—Wenderoth, Lind & Ponack

[57] ABSTRACT

A toilet bowl having a bowl body, a seat mounted on the bowl body, and a lid mounted on the seat. The seat and the lid are hinged to the rear of the bowl body. A handle is removably attached to the underside of the seat and/or lid to swing them open.

1 Claim, 7 Drawing Figures

TOILET BOWL

BACKGROUND OF THE INVENTION

1. Field of the Invention

The present invention relates to improvements in a toilet bowl.

2. Description of the Prior Art

A toilet bowl has a bowl body, a horseshoe-shaped seat resting on the rim of the bowl body, and a lid adapted to be placed on the seat. The seat and the lid are hinged to the rear portion of the rim of the bowl. At the time of men's defecation and for women's use, the lid alone is opened so that the user can sit on the seat. When a man urinates, both the lid and the seat are swung open.

Unlike household water closets, those which are open to the public are apt to make a user assume that the lid and the seat, and especially the latter, have been stained by others. Thus, a man often urinates in a public lavatory without swinging the seat open, because a sense of filthiness makes him hesitate to touch the seat to swing it open. Such a disregard for the public results in actually soiling the seat and thereby rendering the toilet unusable for defecation.

To solve the above-described disadvantage, electric and foot-operated devices for swinging the lid and the seat have already been proposed. However, such devices have the following disadvantages. Firstly, they require expensive equipment. Secondly, the automization of swinging motion of the lid and the seat is unsuitable for public lavatories. Thirdly, such devices, especially foot-operated type, are liable to cause trouble when roughly handled. Fourthly, the user of a foot-operated device must keep his foot on the pedal all the time during defecation or urination. Lastly, if the lid and/or the seat is restored to the horizontal position by spring action, either they or nichrome wire accommodated therein for heating purpose may be damaged by the impact.

OBJECTS AND SUMMARY OF THE INVENTION

It is an object of the present invention to provide a toilet bowl having a lid and a seat which can be manually swung on a pin without giving a sense of filthiness to the user.

It is another object of the present invention to provide a toilet bowl having a lid and a seat which are free from trouble or damage when they are restored to the horizontal position.

It is still another object of the present invention to provide a toilet bowl in which the means for manually swinging the lid and the seat do not constitute an obstacle in laying covers for them.

In accordance with the present invention, the lid and the seat or at least the latter only is provided with a handle which projects sideways from its side edge so as to provide a means for manually swinging them. This arrangement obviates the necessity of directly touching the lid or the seat. One can do without feeling uncomfortable under an assumption that the seat has been stained by others.

The handles are detachable in the preferred embodiments of the present invention so that they may be detached when a cover is laid on the lid or the seat. Thus the work of laying covers on them is facilitated.

BRIEF DESCRIPTION OF THE DRAWING

With the above-mentioned objects in view and as will become apparent from the following detailed description, the present invention will be more clearly understood in connection with the accompanying drawings, in which.

DETAILED DESCRIPTION OF THE PREFERRED EMBODIMENT

Figure 1:
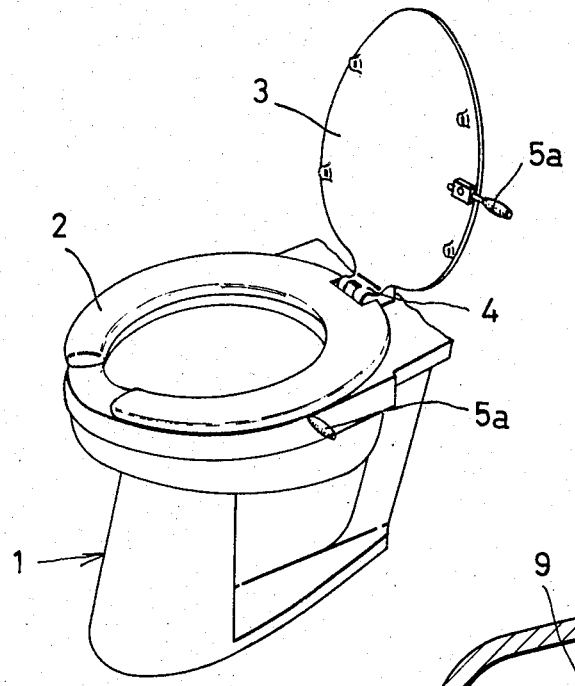
FIG. 1 is a perspective view of the first embodiment of the present invention with its lid kept open.

Referring now to FIG. 1, a toilet bowl in accordance with the present invention includes a bowl body 1, a seat 2 resting on the rim of the bowl body 1, and a lid 3 adapted to be placed on the seat 2. The seat 2 and the lid 3 are hinged to the rear portion of the rim of the bowl body 1 through knuckles 4 so that the seat 2 and the lid 3 are adapted to separately swing about a pin. The seat 2 and the lid 3 are provided with detachable handles **5*a*** which project sideways from their side.

Figure 3:
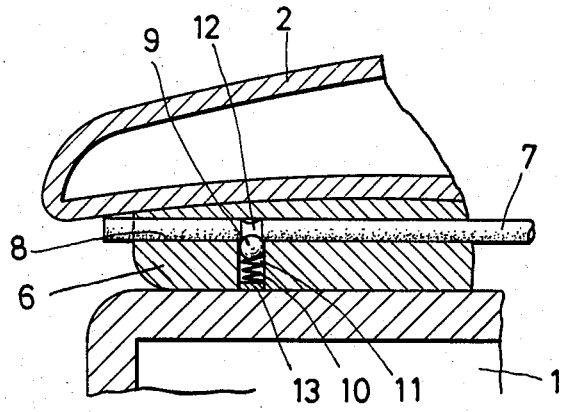
FIGS. 2 and 3 are partially cutaway sectional front views of portions thereof.
Figure 2:
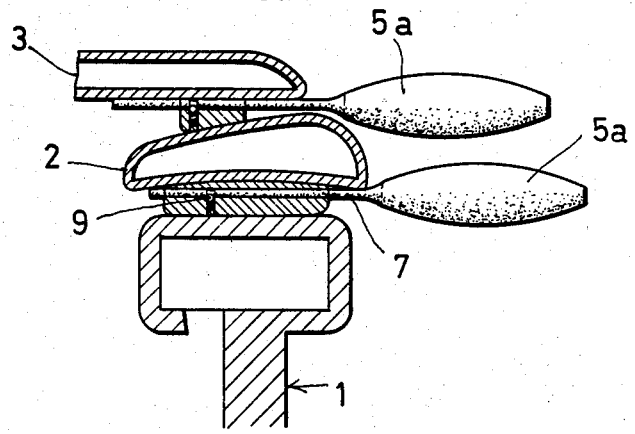

Referring now to FIG. 3, the detachability of the handle **5*a* is afforded by an underbed 6 secured to the undersurface of the seat 2, a rod 7 extending from the handle 5*a* through a hole 8 provided in the underbed 6, a ball 9 accommodated in a hole 11 provided in the underbed 6 perpendicularly to the hole 8 so as to communicate therewith, and a coil spring 10 accommodated in the hole 11 in such a manner that the coil spring 10 abuts on a stopper 13 put on the bottom of the hole 11 while the other end of the coil spring 10 abuts on the ball 9. The rod 7 is prevented from accidentally slipping out of the hole 8 because the ball 9, which is urged upwardly by the coil spring 10 is received by an annular groove 12 provided in the rod 7**.

Figure 4:
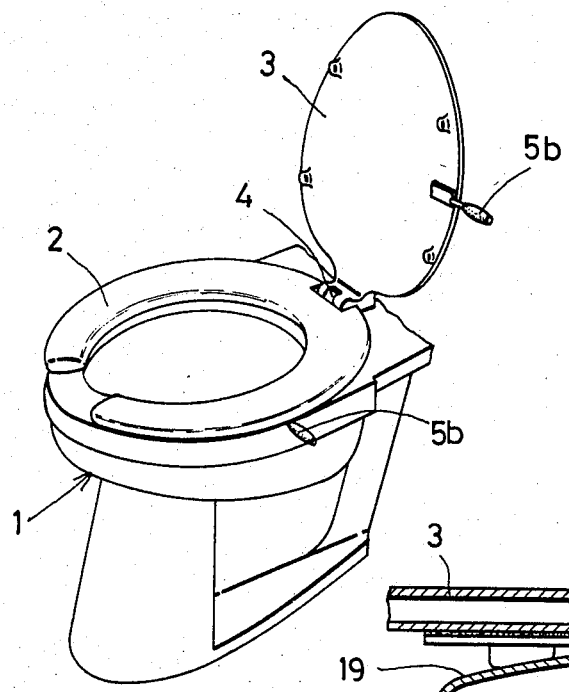
FIG. 4 is a perspective view of the second embodiment of the present invention with its lid kept open.
Figure 5:
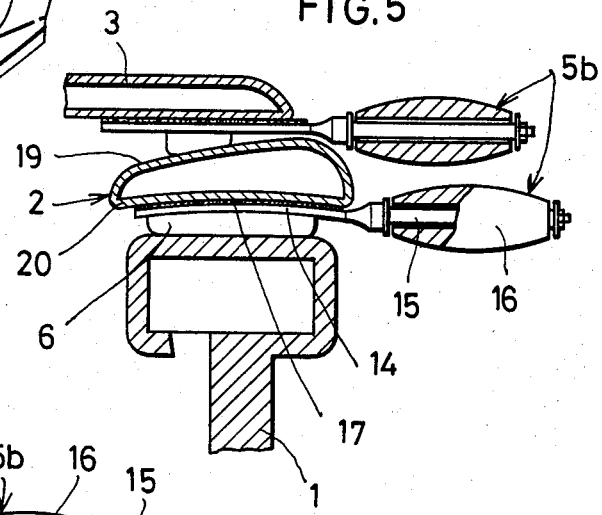
FIG. 5 is a partially cutaway sectional front view of a portion thereof with the lid kept closed.
Figure 6:
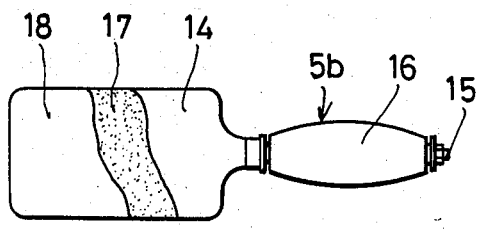
FIG. 6 is a partially cutaway plan view of a handle used therein.

Referring now to FIGS. 4 to 6, the second embodiment of the present invention is characterized by a handle **5*b* comprising a base 14 of tabular construction. The base 14 terminates in a handle bar 15 on which a handle 16 is mounted. The base 14 is coated on one side with a pressure-sensitive adhesive 17 so as to adhere to the undersurface of the seat 2 or the lid 3**.

A sheet of paper 18 coated with a surface lubricant is applied to the surface of the pressure-sensitive adhesive 17. In the alternative, the pressure-sensitive adhesive 17 may be squeezed from a tube and applied to the base 14 just before the handle **5*b* is adhered to the undersurface of the seat 2 or the lid 3**.

A hollow seat 2 has an upper wall 19 and a lower wall 20, the former being cambered to a greater degree than the latter. As the case may be, however, the seat 2 may not be hollow but solid.

In view of various degrees in which the seats 2 and lids 3 are cambered, it is preferable that the base 14 of the handle **5*b* can be bent so as to be adjustable to the camber of each seat 2 or lid 3**.

Figure 7:
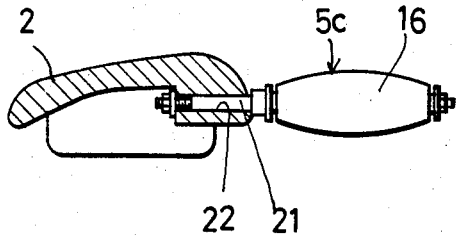
FIG. 7 is a fragmentary vertical sectional view of the third embodiment of the present invention.

Referring now to FIG. 7, the third embodiment of the present invention is characterized by a handle **5*c* having a handle bar 21 on one end of which a handle 16 is mounted. The handle bar 21 extends through a hole 22 provided laterally in the outer edge of the seat 2**.

I claim:

1. A toilet bowl, comprising:

a bowl body having a rear portion;

a seat being mounted on the bowl body and having an underside;

a lid being mounted on the seat and having an underside;

hinge means, being secured to the rear portion of the bowl body, for swinging the set and the lid away from the bowl body;

a first underbed being secured to the underside of the seat;

a second underbed being secured to the underside of the lid and being positioned directly above the first underbed;

first bore means extending completely laterally through the first underbed;

second bore means extending completely laterally through the second underbed;

first handle means, removably secured in the first bore means, for swinging either the seat alone or the seat and the lid together away from the bowl body;

second handle means, removably secured in the second bore means, for swinging the lid alone away from the seat and the bowl body;

first means, arranged in the first underbed, for removably securing the first handle means in the first bore means;

second means, arranged in the second underbed, for removably securing the second handle means in the second bore means;

wherein said first securing means includes a first annular groove in the first handle means;

a vertically oriented first hole in communication with the first bore means;

a first ball detent movable in the first hole and engageable with the first annular groove;

a first spring means, arranged in the first hole, for forcing the first ball detent into engagement with the first annular groove; and a first stopper means, arranged in the first hole, for retaining the first spring means in the first hole; and wherein said second securing means includes a second annular groove in the second handle means;

a vertically oriented second hole in communication with the second bore means;

a second ball detent movable in the second hole and engageable with the second annular groove;

a second spring means, arranged in the second hole, for forcing the second ball detent into engagement with the second annular groove; and a second stopper means, arranged in the second hole, for retaining the second spring means in the second hole.

* * * * *